US007409988B2

(12) United States Patent
Borden et al.

(10) Patent No.: US 7,409,988 B2
(45) Date of Patent: Aug. 12, 2008

(54) BLOWOUT PREVENTER PACKING ELEMENT WITH NON-METALLIC COMPOSITE INSERTS

(76) Inventors: Kelly Borden, 5001 - 47 Street, Beaumont, Alberta (CA) T4X 1J2; Quinn Holtby, 5606 - 103 A Street, Edmonton, Alberta (CA) T6H 2J5

( * ) Notice: Subject to any disclaimer, the term of this patent is extended or adjusted under 35 U.S.C. 154(b) by 409 days.

(21) Appl. No.: 10/774,252

(22) Filed: Feb. 6, 2004

(65) Prior Publication Data

US 2005/0072566 A1 Apr. 7, 2005

(51) Int. Cl.
*E21B 23/00* (2006.01)

(52) U.S. Cl. ..... 166/84.1; 166/84.3

(58) Field of Classification Search ..... 166/84.1, 166/84.3, 81.1, 86.1
See application file for complete search history.

(56) References Cited

U.S. PATENT DOCUMENTS 2,609,836 A 9/1952 Knox ..... 137/618
3,667,721 A * 6/1972 Vujasinovic ..... 251/1.1
4,358,085 A * 11/1982 Regan et al. ..... 251/1.2
4,480,703 A * 11/1984 Garrett ..... 175/195
6,109,348 A * 8/2000 Caraway ..... 166/84.3
2003/0226668 A1 * 12/2003 Zimmerman et al. ..... 166/387

FOREIGN PATENT DOCUMENTS

CA 1178196 6/1982

* cited by examiner

*Primary Examiner*—William P Neuder
(74) *Attorney, Agent, or Firm*—Antony C. Edwards

(57) ABSTRACT

A packing element for a blowout preventer includes an annular flexible non-metallic composite body disposed about a longitudinal axis that is adapted to be compressively displaced inwardly towards the axis. A plurality of non-metallic composite inserts are embedded in the body in generally circular fashion spaced apart in respective radial planes extending form the axis for reinforcing the body. Each of the inserts includes upper and lower flanges, and a web element extending between the flanges. The web element includes trailing and leading edges, each having outer arcuate surface that are substantially semicircular in cross-section for distributing the loads applied to a bond line between the insert and the flexible non-metallic composite body during the operation of the packing element. A central rib extends between the leading and trailing edges. The replacement of metal inserts with non-metallic composite inserts eliminates sparks and scoring of string, which leads to explosions.

6 Claims, 3 Drawing Sheets

BLOWOUT PREVENTER PACKING ELEMENT WITH NON-METALLIC COMPOSITE INSERTS

FIELD OF THE INVENTION

The present invention relates to a blowout preventer packing element with non-metallic composite inserts.

BACKGROUND OF THE INVENTION

The present invention relates to annular type blowout preventers and similar equipment used to control pressures while drilling a well, and more particularly to packing element elements and inserts used in such equipment. U.S. Pat. No. 2,609,836 to Knox and Canadian Patent No. 1,178,196 to Huey, Wai J. describes annular type blowout preventer packing units which incorporate metal inserts spaced about the packing element central axis, and embedded by a rubber body. Upon inward constriction of the unit about a well drill pipe, or upon itself, the rubber squeezed radially inwardly with resistance imposed by the inserts to which the rubber is anchored. Well pressure exerted upwardly upon the stretched or extended rubber also tends to displace it upwardly, so that the material, is subjected to strain both radially and vertically. This causes fatigue and weakening of the material, particularly after repeated closure of the preventer unit, so that each unit is normally rated as to its capability to safely sustain or withstand a certain number of closures, but the problem of extreme stretching of the rubber has limited the success of such efforts.

It is a major objective of the present invention to provide an improved blowout preventer unit characterized in that the capability of non-metallic composite inserts to effectively anchor the flexible non-metallic composite packing element under extreme well pressure is substantially enhanced, with the result that fracturing of the packing element is substantially reduced, and with the result that the life of the preventer unit is materially enhanced.

It is therefore an object of the present invention to provide non-metallic composite inserts for use in a packing element wherein the leading and trailing edges of the non-metallic composite insert exhibit a relatively large, and arcuate surface area so as to reduce the stress and strains developed at the bond line between the inserts and the flexible non-metallic composite body in the packing element.

It is an object of the present invention to provide such a non-metallic composite insert that eliminates the risk of generating sparks when in contact with drill string when tripping or stripping in and out of the well bore. Eliminating sparks is very important, as these sparks are known causes of fires and explosions.

It is a further object of the present invention to provide such a non-metallic composite insert that eliminates metal use in conventional inserts so that the over all weight of the blowout preventer is substantially reduced.

It is a still further object to provide a non-metallic composite insert having a dumbbell shaped cross-section, somewhat like an I-beam in construction, to provide efficient load bearing capabilities through the geometry of the insert.

These and other objects and advantages of the invention, as well as the details of illustrative embodiments, will be more fully understood from the following description and drawings.

SUMMARY OF THE INVENTION

Two embodiments of the blowout preventer packing element with non-metallic composite inserts will hereinafter be further described.

The objects described above, as well as other objects and advantages are achieved by a packing element for a blowout preventer, and more particularly, by the non-metallic composite inserts used within the packing element. The packing element includes an annular flexible non-metallic composite body disposed about a longitudinal axis that is adapted to be compressively displaced inwardly towards the axis. A plurality of the non-metallic composite inserts are embedded in the body in generally circumferential fashion spaced apart in respective radial planes extending from the axis for reinforcing the body.

Each of the inserts include upper and lower flanges, and a web element extending between the flanges. The web element includes leading and trailing edges, each having outer arcuate surfaces that are substantially semicircular in cross-section for distributing the loads applied to a bond line between the insert and the flexible non-metallic composite body during the operation of the packing element. A central rib extends between the leading and trailing edges. The rib is thinner than the edges so that the web element exhibits a substantially dumbbell shaped cross section for effective reinforcement of the flexible non-metallic composite body. An alternative embodiment of a packing element for a blowout preventer is a rigid, perforated non-metallic composite insert and/or a non-metallic composite insert with corrugated surfaces. Both of these alternatives may enhance the bonding characteristics between insert and packing element.

DETAILED DESCRIPTION OF THE PREFERRED EMBODIMENT

Figure 1:
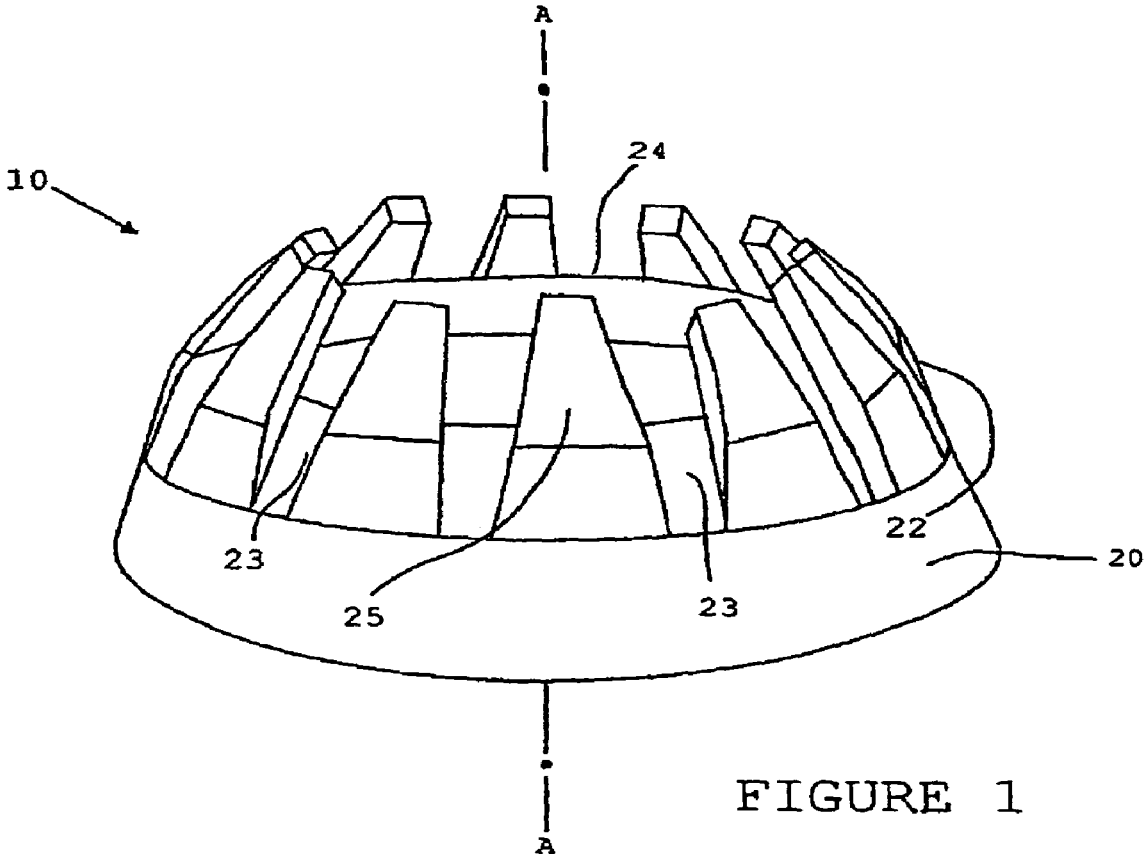
FIG. 1 is an elevation view of a blowout preventer element in accordance with the present invention.

The preferred embodiment, a blowout preventer packing element with non-metallic composite inserts generally identified by reference numeral 10, will now be described with reference to FIGS. 1 through 4.

Structure and Relationship of Parts:

Referring to FIG. 1*a*, packing element 10 has annular body of flexible non-metallic composite material 20 disposed about central axis A- -A of the blowout preventer, and is adapted to be constricted or compressively displaced inwardly towards the central axis. The annular body includes a plurality of equally and circularly spaced non-metallic composite inserts 25 embedded in the body of flexible non-metallic composite material about the central axis.

Non-metallic composite inserts 25 are adapted to move with the flexible non-metallic composite material 20, as the material is forced toward the center of the preventer by actuator and preferably positioned in the flexible non-metallic composite at the time of molding annular body 20. The inserts are made of a non-metallic composite material, but other rigid composite materials are similarly suitable. The non-metallic composite inserts are bonded to the flexible non-metallic composite material during the molding process.

Figure 4:
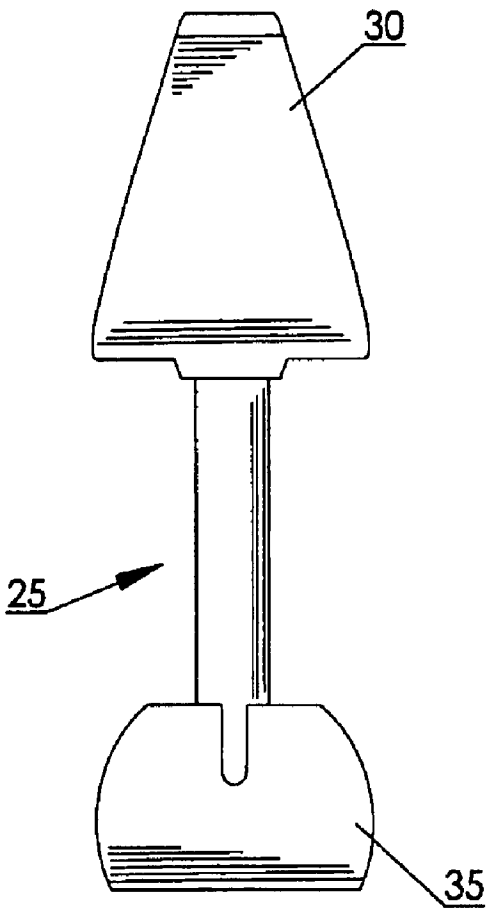
FIG. 4 is an edge-wise elevation view of the non-metallic composite insert.
Figure 3:
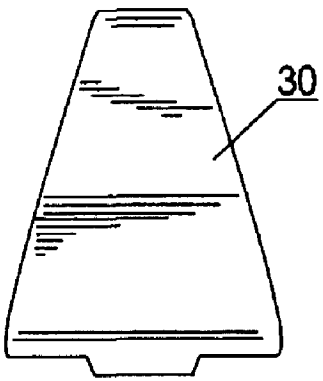
FIG. 3 is a plane view of the non-metallic composite insert.
Figure 2A:
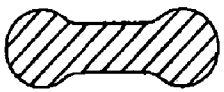
FIG. 2*a* is a cross-sectional view along line 2*a*-2*a* in FIG. 2.
Figure 2:
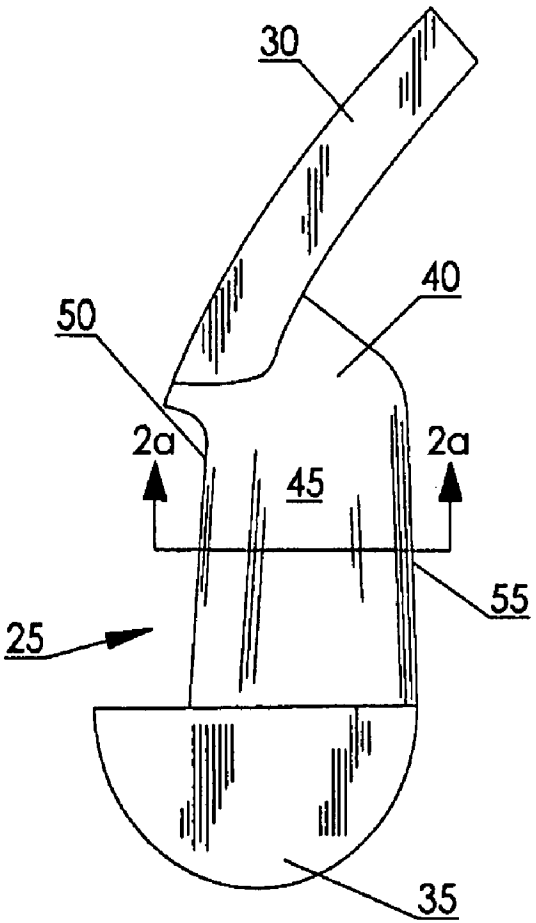

Referring to FIGS. 2 to 4, non-metallic composite insert 25 is provided with upper and lower wedge-shaped flanges 30 and 35 and connecting vertical web 40 attached to and extending between the flanges in generally inclined fashion at a slight angle to the axis of the opening through the preventer. Each web has a generally flat sided or planar flange-connecting rib 45 extending between and connected to the upper and lower flanges 30 an 35 and positioned in a radial plane extending from the axis of the preventer. The web further includes arcuate edge portions 50 and 55 that are circular, or at least semi-circular in cross-section and integrally connected to the edges of the flat sided rib member. The web 40 of each non-metallic composite insert exhibits a dumbbell shaped cross section, somewhat like a I-beam. In other words, the shape of the web portion permits the reduction of the insert volume in packing element 10, while providing sufficient load bearing reinforcement for the annular body through the advantageous geometry of the web.

Arcuate edge portions 50 and 55, of each insert web provide relatively large areas at the leading and trailing surfaces of each insert in the packing element for greater distribution of the forces applied to the bond line between insert 25 and flexible non-metallic composite material 20 in the packing element 10. Thus, the shape of the leading and trailing edges of the insert reduces the stress concentration at those surfaces, in comparison to the prior art structures, and thereby reduces the resulting strains in that region of the packing element. In this fashion, the stress imposed on flexible non-metallic composite material 20 when the flexible non-metallic composite material is forced into position to seal the opening through preventer is reduced.

Upward movement of a piston actuator causes a radial constriction of packing element 10, resulting in an elastomeric flowing or extruding of the flexible non-metallic composite in annular body 20. The direction of the extrusion is primarily inward, because upper and lower flanges 30 and 35, confine the non-metallic composite against vertical extrusion. The only vertical extrusion of the non-metallic composite occurs within spaces 23 between the flanges of adjacent inserts, and outwardly of the outer ends of the flanges at in the annular body 20.

The packing element 10, of the present invention is adaptable to numerous bore conditions and sizes.

As stated above, upper and lower flanges 30 and 35, of the inserts 25, serve to control endwise flow of the flexible non-metallic composite material in the packing element 10, but the web components 40, of the inserts 25, also plays a part in directing the flow, of non-metallic composite. Annular flexible non-metallic composite body 20 is molded so that its outer surface 22 projects radially outwardly beyond the outer edges of the non-metallic composite inserts, so that cushion layer of non-metallic composite is disposed between the inserts. As the packing element is compressed inwardly, the avenge diameter of packing element surface 22, is reduced, producing a displacement of the flexible non-metallic composite material that carries non-metallic composite inserts 25 inwardly Via the adhesive bond between the flexible non-metallic composite and the non-metallic composite inserts, particularly via the non-metallic composite/non-metallic composite bond line at the arcuate trailing (outer edge 55) of the web portion of the inserts. The flexible non-metallic composite displacement is greatest in spaces 23 between the inserts since this portion of the non-metallic composite is compressed by the inserts as they are moved together by the advancement of actuator, and further because the portions of the non-metallic composite lying in respective spaces 23, are furthest from the non-metallic composite/elastomeric bond fines. The bond lines at the respective leading edges of the inserts restrict movement of the non-metallic composite ahead of the leading inner arcuate edges 23, of the elastomeric web portions, producing an inward bulging of the non-metallic composite material at inner surface 24, ahead of spaces 23, when the packing element 10, is compressed.

The I-beam like geometry of the dumbbell shaped web portions provides the optimum reinforcing capabilities for a given volume of flexible non-metallic composite material in the packing element 10. This relationship, together with the reduced stress and strain produced at the bond line by the relatively large surface area at the leading and trailing arcuate edge portion 50 and 55, of the webs 40, leads to an increase in the number of closures that the packing element can safely sustain in operation.

Figure 5:
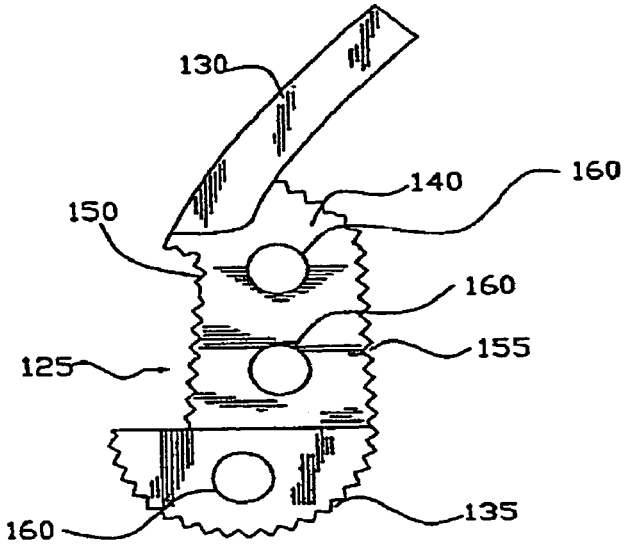
FIG. 5 is a side view of an alternative embodiment of the rigid, perforated non-metallic composite insert with corrugated surfaces constructed in accordance with the teachings of the present invention.
Figure 6:
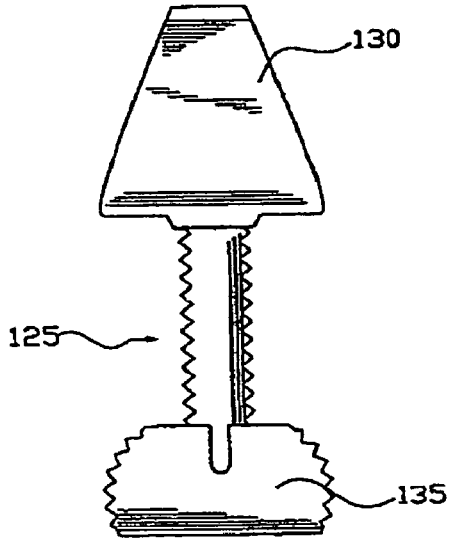
FIG. 6 is an edge-wise elevation view of the rigid, perforated non-metallic composite insert with corrugated surfaces.

Alternative Embodiment:

Referring to FIGS. 5, and 6, there is illustrated an alternative embodiment of a blowout prevent packing element with non-metallic composite inserts 25, which includes a rigid, perforated non-metallic composite inserts with corrugated surfaces 125. Each of the inserts 125, include upper 30, and lower corrugated and perforated flange 135, and a corrugated and perforated web element 140, extending between the flanges. The perforated and corrugated web element includes leading and trailing edges, each having outer arcuate surfaces 150 and 155, that are substantially semicircular in cross-section for distributing the loads applied to a bond line between the insert and the flexible non-metallic composite body during the operation of the packing element 10. A central perforated rib 160, extends between the leading and trailing edges. The perforated rib 160, is thinner than the edges so that the perforated web element exhibits a substantially dumbbell shaped cross section for efficient reinforcement of the flexible non-metallic composite body.

In this patent document, a reference to an element by the indefinite article "a" does not exclude the possibility that more than one of the elements is present, unless the context clearly requires that there be one and only one of the elements.

It will be apparent to one skilled in the art that modifications may be made to the illustrated embodiment without departing from the spirit and scope of the invention as hereinafter defined in the claims.

The embodiments of the invention in which an exclusive property or privilege is claimed are defined as follows:

1. Non-metallic composite inserts for use in an annular blowout preventer packing element where the packing element includes flexible non-metallic composite body disposed about a longitudinal axis, the flexible non-metallic composite body carrying the non-metallic composite inserts in respective radial planes extending from the center of the packing element and adapted to be compressively displaced inwardly towards the axis upon vertical actuation of the packing element, each of the inserts comprising;

upper and lower flanges;

a web element extending between said flanges, said web element including leading and wailing edges each having outer arcuate surfaces that are substantially semicircular far distributing loads applied to a bond line between the inserts and the flexible non-metallic composite body during the operation of the packing element, and a central rib extending between the edges, the rib being thinner than the edges, whereby said web element exhibits a substantially dumbbell-shaped cross section for efficient reinforcement of the flexible non-metallic composite body, whereby, because the inserts are non-metallic, sparks are inhibited between the inserts and a drill string in a borehole in which the packing element is mounted, the need to remove the drill string from the borehole due to the packing element is reduced, and wear is reduced.

2. A packing element for an annular blowout preventer which includes a flexible non-metallic composite body disposed about a longitudinal axis and adapted to be compressively displaced inwardly toward the axis upon vertical actuation of the packing element; a plurality of non-metallic composite inserts mounted in said body in substantially circumferentially spaced fashion in respective radial planes extending from central vertical axis of said body, each of said inserts comprising:

upper and lower flanges; a web element extending between the flanges, the web element including leading and trailing edges each having outer arcuate surfaces that are substantially semicircular for distributing the loads applied to a bond line between said insert and said flexible non-metallic composite body during the operation of the packing element, and a central rib extending between the edges, The rib being thinner than the edges, whereby the web element exhibits a substantially dumbbell-shaped cross section for efficient reinforcement of the said flexible non-metallic composite body, whereby, because the inserts are non-metallic, sparks are inhibited between the inserts and a drill string in a borehole in which the packing element is mounted, the need to remove the drill string from the bore hole due to the packing element is reduced, and wear is reduced.

3. A blowout preventer packing element having a flexible non-metallic composite body including a plurality of spaced non-metallic composite inserts embedded in the flexible non-metallic composite body for moving with the flexible non-metallic composite body as the flexible non-metallic composite body is forced toward the center of the preventer to engage a tubular member extending through the preventer or to close the opening through the annular flexible non-metallic composite body, the improvement comprising:

providing each non-metallic composite insert with generally wedge-shaped upper and lower flanges and a connecting web attached to and extending between said flanges, said web comprising:

a generally flat-sided flange connecting member extending between and connected to said upper and lower flanges and positioned in a radial plane extending from the center of said preventer; and edge portions having a circular cross-section and integrally connected to the edges of the sided flange;

wherein said flat-sided flange is thinner than said edge portions and said web exhibits a substantially dumbbell-shaped cross-section whereby the volume of said non-metallic composite inserts embedded in the flexible non-metallic composite body is reduced and whereby stress concentrations imposed on the flexible non-metallic composite body when the flexible non-metallic composite body is forced into position to seal the opening through the preventer are reduced, whereby, because the inserts are non-metallic, sparks are inhibited between the inserts and a drill string in a borehole in which the packing element is mounted, the need to remove the drill string from the borehole due to the packing element is reduced, and wear is reduced.

4. A blowout preventer packing element comprising perforated and corrugated non-metallic composite inserts mounted within a flexible non-metallic composite body, wherein each of said perforated and corrugated non-metallic composite inserts include upper and lower flanges and a corrugated and perforated web element extending between said flanges, and wherein said perforated and corrugated web element includes leading and trailing edges, each having outer arcuate surfaces that are substantially semicircular in cross-section for distributing the-loads applied to a bond between said insert and said flexible non-metallic composite body during the operation of the packing element, and wherein a central perforated rib extends between said leading and trailing edges of said web element and said perforated rib is thinner than said edges so that said web element exhibits a substantially dumbbell-shaped cross section for efficient reinforcement of said flexible non-metallic composite body, whereby, because the inserts are non-metallic, sparks are inhibited between the inserts and a drill string in a borehole in which the packing element is mounted, the need to remove the drill string from the borehole due to the packing element is reduced, and wear is reduced.

5. A blowout preventer packing element comprising perforated non-metallic composite inserts mounted within a flexible non-metallic composite body, wherein each of said perforated non-metallic composite inserts include upper and lower flanges and a perforated web element extending between said flanges, and wherein said perforated web element includes leading and trailing edges, each having outer arcuate surfaces that are substantially semicircular in cross-section for distributing loads applied to a bond between said insert and said flexible non-metallic composite body during the operation of the packing element, and wherein a central perforated rib extends between said leading and trailing edges of said web element, whereby, because the inserts are non-metallic, sparks are inhibited between the inserts and a drill string in a borehole in which the packing element is mounted, the need to remove the drill string from the borehole due to the packing element is reduced, and wear is reduced.

6. A blowout preventer packing element comprising corrugated non-metallic composite inserts mounted within a flexible non-metallic composite body, wherein each of said corrugated non-metallic composite inserts include upper and lower flanges and a corrugated and perforated web element extending between said flanges, and wherein said corrugated web element includes leading and trailing edges, each having outer arcuate surfaces that are substantially semicircular in cross-section for distributing loads applied to a bond between said insert and said flexible non-metallic composite body during the operation of the packing element whereby, because the inserts arc non-metallic, sparks are inhibited between the inserts and a drill string in a borehole in which the packing element is mounted, the need to remove the drill string from the borehole due to the packing element is reduced, and wear is reduced.

* * * * *